US008069931B2

(12) United States Patent
Hooks et al.

(10) Patent No.: US 8,069,931 B2
(45) Date of Patent: Dec. 6, 2011

(54) SYSTEM, METHOD AND APPARATUS FOR DOWNHOLE SYSTEM HAVING INTEGRATED MEASUREMENT WHILE OPERATING COMPONENTS

(75) Inventors: John Michael Hooks, Calgary (CA); Daniel Seutter, Beaumont (CA)

(73) Assignee: Phoenix Technology Services LP, Calgary, Alberta (CA)

( * ) Notice: Subject to any disclaimer, the term of this patent is extended or adjusted under 35 U.S.C. 154(b) by 224 days.

(21) Appl. No.: 12/421,249

(22) Filed: Apr. 9, 2009

(65) Prior Publication Data

US 2010/0258351 A1 Oct. 14, 2010

(51) Int. Cl.
*E21B 47/00* (2006.01)
*E21B 17/16* (2006.01)

(52) U.S. Cl. ..... 175/40; 166/250.11; 166/242.1; 166/66

(58) Field of Classification Search ..... 166/250.11, 166/242.1, 66; 175/40, 61, 62, 92, 107, 320; 340/854.6; 415/903; 73/152.03, 152.43
See application file for complete search history.

(56) References Cited

U.S. PATENT DOCUMENTS

| | | | | |
|---|---|---|---|---|
| 3,866,678 | A | 2/1975 | Jeter | |
| 5,212,495 | A | 5/1993 | Winkel et al. | |
| 5,817,937 | A * | 10/1998 | Beshoory et al. | 73/152.46 |
| 5,883,516 | A | 3/1999 | Van Steenwyk et al. | |
| 6,100,696 | A * | 8/2000 | Sinclair | 324/339 |
| 6,142,244 | A * | 11/2000 | Hesse | 175/45 |
| 6,248,542 | B1 | 6/2001 | Rider et al. | |
| 6,564,883 | B2 | 5/2003 | Fredericks et al. | |
| 6,705,406 | B2 | 3/2004 | Das et al. | |
| 6,839,000 | B2 | 1/2005 | Das et al. | |
| 6,932,154 | B2 | 8/2005 | Zillinger | |
| 7,255,183 | B2 | 8/2007 | Cramer | |
| 7,525,315 | B2 * | 4/2009 | Fredette et al. | 324/342 |
| 2007/0107937 | A1 * | 5/2007 | Sugiura | 175/45 |

FOREIGN PATENT DOCUMENTS

CA 2496170 A1 8/2006

OTHER PUBLICATIONS

Phoenix Technology Income Fund, Eloctromagnetic MWD, www.phoenixcan.com/products/us/mwd/em_mwd.html.
Nevis Energy, Current Loop Telemetry Electromagnetic MWD Tool, www.nevisenergy.com.

* cited by examiner

*Primary Examiner* — Kenneth L Thompson
(74) *Attorney, Agent, or Firm* — Bracewell & Giuliani LLP

(57) ABSTRACT

A drill bit string has an internal steering module for measurement while drilling. A chassis is inserted into a modified drill collar from the axial end, rather than through the side. The chassis has external pockets machined into it from its outer diameter. The size of the longitudinally milled slots in the chassis is determined by the size of the components. The mud flow path is positioned off-center because of the component slots. The geometric shape of the flow path through the tool is shaped to optimize the flow area and maintain a wall thickness that can withstand the mud pressure. The wall thickness surrounding the flow area is proportional to the maximum hydrostatic pressure and the circulation pressure.

23 Claims, 6 Drawing Sheets

SYSTEM, METHOD AND APPARATUS FOR DOWNHOLE SYSTEM HAVING INTEGRATED MEASUREMENT WHILE OPERATING COMPONENTS

BACKGROUND OF THE INVENTION

1. Technical Field

The present invention relates in general to taking measurements while operating a tool downhole and, in particular, to an improved system method and apparatus for a downhole string of equipment having integrated measurement while operating components.

2. Description of the Related Art

Measurement while drilling (MWD) systems are used for monitoring the path of the wellbore as it is drilled, and for evaluation of the formation that surrounds the wellbore. The MWD tool comprises numerous sensors, electronic controlling boards, a power source, and a transmitter. These components are installed inside a pressure housing and typically centralized in the bore of a conventional non-magnetic drill collar. The drill collar is typically positioned on the top end of the mud motor. The mud motor rotates the drill bit at an offset angle so as to cause a deviation in the wellbore path. The orientation of this offset angle is monitored by the MWD tool, and the collected data is sent to the surface where it is displayed to the drilling crew. The crew uses this data to reorient the drill string as needed to control the wellbore path.

The presence of the MWD tool centralized in the drill collar, however, reduces the mud flow area and interrupts the flow pattern. This flow restriction created by MWD also minimizes the size and concentration of particulate that can be present in the drilling mud. These types of mud components or loss circulation materials (LCM) are used to control and reduce, for example, the loss of mud volume to the formation that is being penetrated and frictional drill string drag. Although known solutions are workable, it would be beneficial to perform measurement during operation without having a reduced flow area or compressed cross-section of the flow area through the downhole tool.

SUMMARY OF THE INVENTION

Embodiments of a system, method, and apparatus for a downhole string having integrated measurement while operating components are disclosed. For example, a drilling member may contain measurement while drilling (MWD) components has a unique shape and elements. A chassis has external slots or pockets machined into it from its outer diameter. The size of the longitudinally milled slots in the chassis is determined by the size of the components. The chassis is then inserted and sealed into a modified drill collar from the axial end. The mud flow path is positioned off-center because of the component slots. The geometric shape of the flow path through the tool is shaped to optimize the flow area and maintain a wall thickness that can withstand the mud pressure. The wall thickness surrounding the flow area is driven by the sum of the maximum hydrostatic pressure and the circulation pressure.

The flow path contains no obstructions, thereby allowing the drilling operation to utilize a larger size and higher concentrations of loss circulation materials. The design reduces the number of seals required to only one (or a single set) at each end of the chassis, which enhances the overall system reliability. The MWD components are mounted in the chassis slots before the chassis is inserted into the modified drill collar from one axial end. The flow diverters are held in place on the axial ends of the chassis with other drilling subs. The flow diverters are designed to provide a smooth transition for the mud flow cross-sectional areas, and to control material erosion.

At the upper end of the tool, an isolation connection may be attached as part of a gap sub. The gap sub provides a means for the data signal to be transmitted to surface. The transmission signal comprises an electromagnetic signal that is driven onto the drill string sections that exist on either side of the insulated connection. The orientation of the integrated MWD system with respect to the offset bend of the mud motor must be known. A series of alignment pins may be used to maintain orientation.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Referring to FIGS. 1-6, embodiments of a system, method and apparatus for a downhole string of equipment having integrated measurement while operating (MWD) components are disclosed. For example, the string may comprise a drill bit string or other rotary steerable device, and may include an internal steering module for tool orientation purposes during measurement while drilling (MWD).

Figure 1:
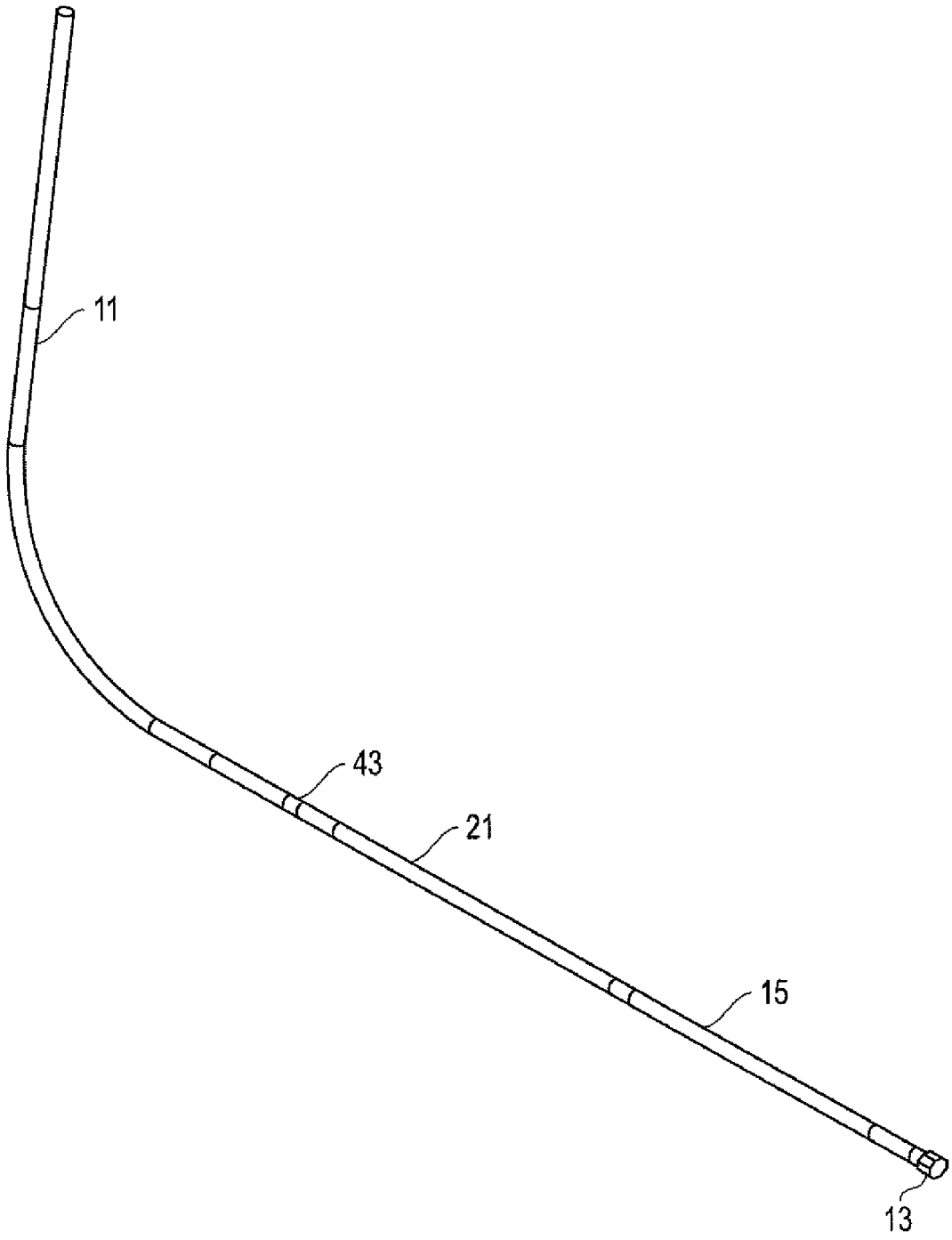
FIG. 1 is a schematic view of one embodiment of a drill string layout constructed in accordance with the invention.

In the illustrated embodiment of FIG. 1, a drill string 11 comprises a drill bit 13 and a mud motor 15 mounted to the drill string 11. Other types of tools, such as rotary steerable devices, also may be used depending on the objectives and applications. The drill string 11 may include a measurement while drilling (MWD) integrated system 21. The MWD integrated system 21 is mounted or otherwise coupled to the mud motor in the embodiment shown. Some embodiments of the MWD integrated system 21 have an overall length of about 18 feet, although the length may vary as modules and sensors are added or removed. Other subs, collars or centralizers also may be included in the drill string, depending on the application.

Figure 4:
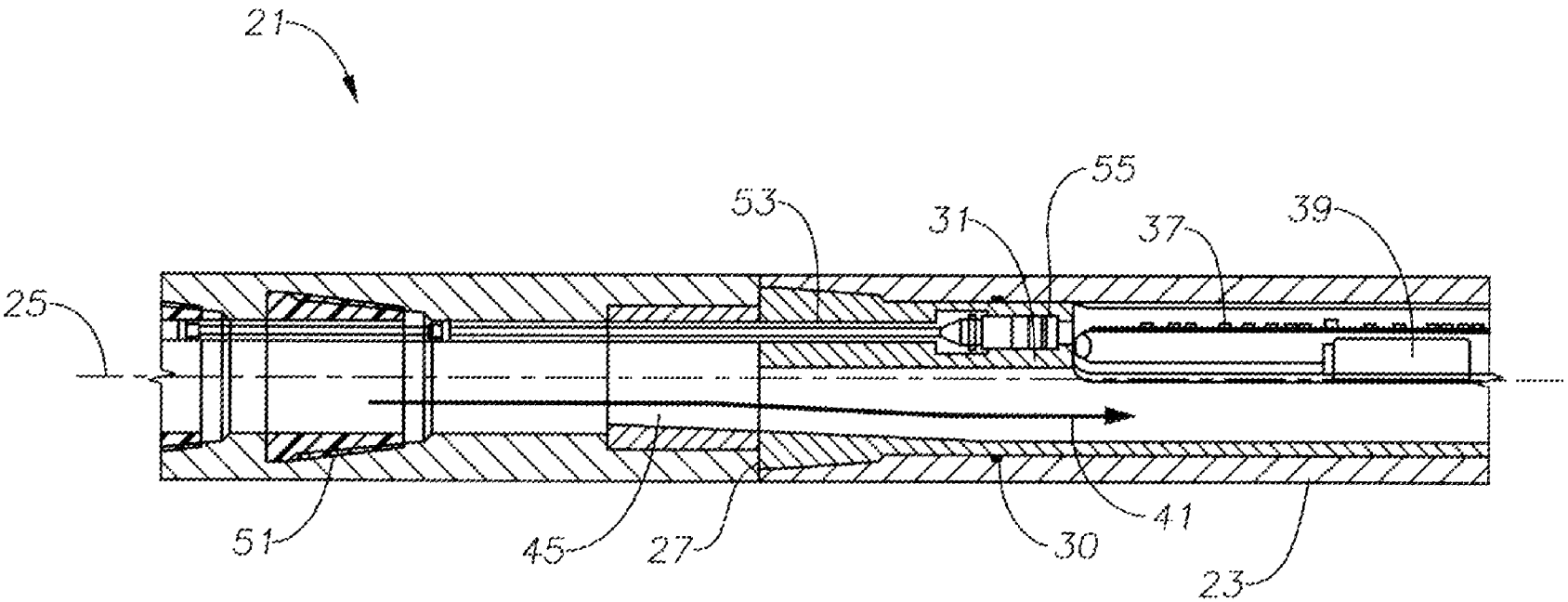
FIG. 4 is an enlarged sectional side view of one embodiment of a proximal end of the drill collar of FIG. 3, and is constructed in accordance with the invention.
Figure 5:
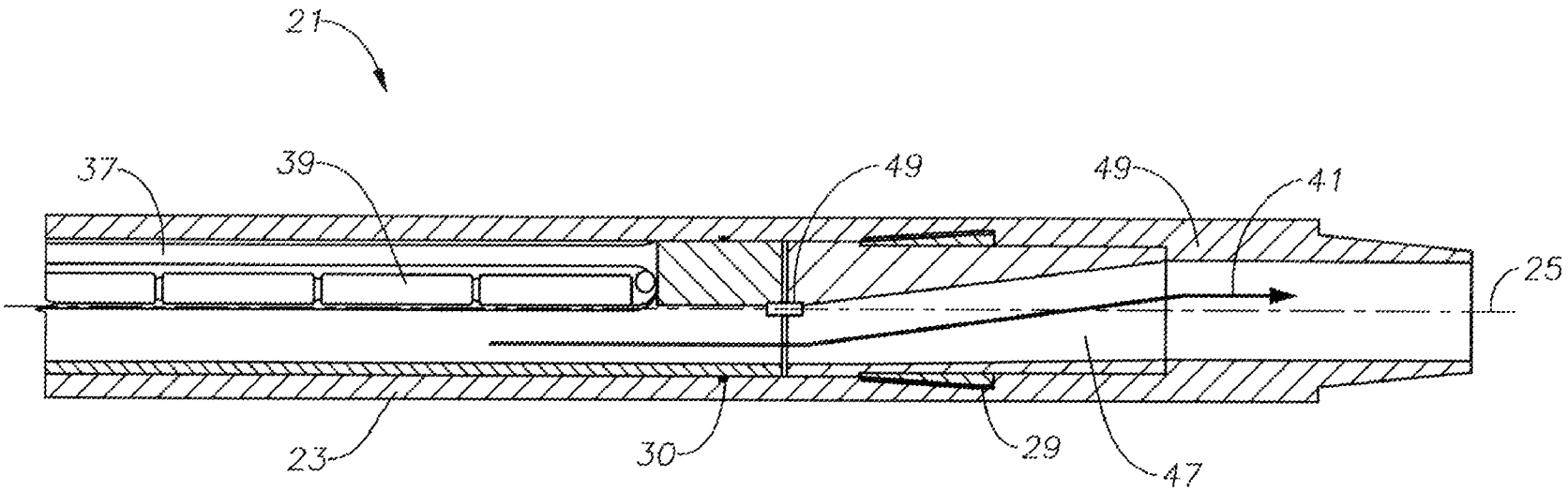
FIG. 5 is an enlarged sectional side view of one embodiment of a distal end of the drill collar of FIG. 3, and is constructed in accordance with the invention.

The MWD integrated system 21 comprises a drill collar 23 (FIG. 2) having an axis 25 (FIGS. 3-5), axial end openings 27, 29 (FIGS. 4 and 5, respectively). The drill collar 23 has a smooth, uniform cylindrical exterior surface with no external pockets. The MWD integrated system 21 has only one seal 30 (e.g., o-ring and back-up ring) at each axial end of a chassis 31 to reduce the risk of mud invasion. Alternatively, the system may be provided with a single set of seals on each end, such as a seal and redundant seal, at each end of the chassis.

The chassis 31 is mounted in the drill collar 23 through one of the axial end openings 27. The chassis 31 has external pockets 33, 35 formed in an exterior thereof. The external pockets 33, 35 may be machined into the chassis 31 from an outer diameter thereof such that the external pockets 33, 35 comprise longitudinally milled slots. Various MWD components 37 are mounted in at least one of the external pockets 33, 35. The external pockets 33, 35 also may house an internal steering module (e.g., a series of electronics hoards and modules) for measurement while drilling. Other sleeves or components may be located between the drill collar 23 and the chassis 31. The MWD components 37, 39 are mounted in the chassis slots or pockets 33, 35 before the chassis 31 is inserted into the modified drill collar 23 from one axial end 27.

Figure 2:
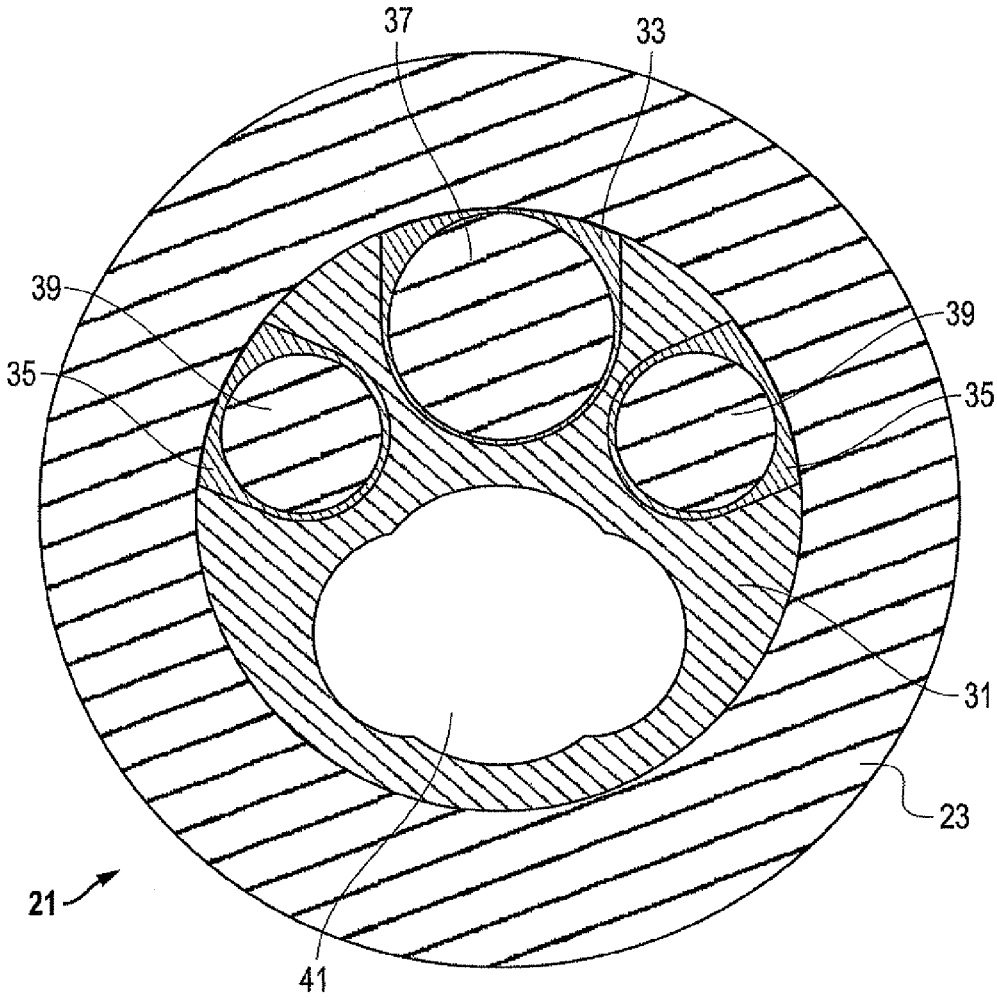
FIG. 2 is a sectional axial view of one embodiment of a drill collar constructed in accordance with the invention.
Figure 3:
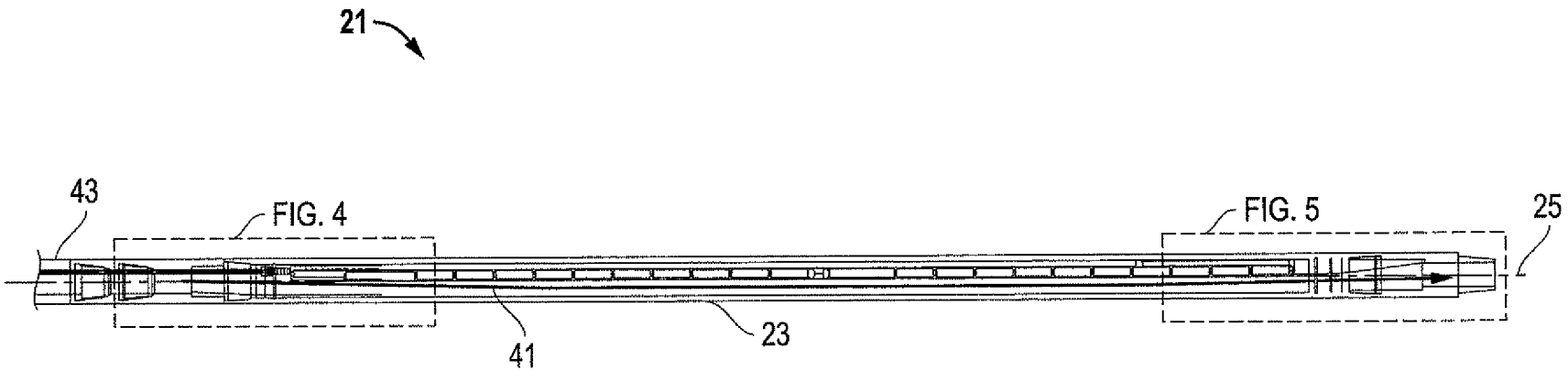
FIG. 3 is a partially sectioned side view of one embodiment of a drill collar constructed in accordance with the invention.

The chassis 31 further comprises a mud flow path 41 extending therethrough in an axial direction. In the embodiment of FIG. 2, the sensors and electronics 37 are located opposite the mud flow path 41, and the batteries 39 are located on each side of the mud flow path 41 adjacent the sensors and electronics 37. As shown in the illustrated embodiments, the mud flow path 41 is positioned axially on-center adjacent the axial ends of the MWD integrated system 21 (FIGS. 4 and 5), and positioned axially off-center between the axial ends to compensate for the external pockets 33, 35.

The MWD integrated system 21 may further comprise flow diverters 45, 47 adjacent the axial ends for providing a smooth transition of mud through the chassis 31 and to control material erosion. The flow diverters 45, 47 may be retained between the chassis 31 and other drilling subs. As best shown in FIG. 2, the mud flow path 41 may be configured with a cross-sectional shape comprising a multi-lobed aperture (e.g., a large circular shape amalgamated with two smaller circular shapes on the lateral sides of the large circular shape) without obstructions extending therein. A wall thickness of the chassis 31 surrounding the mud flow path 41 may be selected to withstand the pressure loading caused by a sum of a maximum hydrostatic pressure in the well and a circulation pressure in the mud flow path. As shown in FIG. 5, the MWD integrated system 21 has one or more alignment pins 49 to maintain angular orientation of the chassis 31 with respect to an offset bend of the mud motor 15.

In some embodiments, a communications device 43 (e.g., gap isolation assembly in FIGS. 1 and 3) is mounted or otherwise coupled to the MWD integrated system 21. In an alternate embodiment, a mud pulser or a combination of a mud pulser and gap isolation assembly may be used for transmission. EM systems send data more quickly, but there are formations that attenuate the signal beyond recognition. The system may be down-linked or signaled to change over to utilize the mud pulser. In some embodiments, the gap isolation assembly 43 comprises an isolation connection 51 (FIG. 4) and permits a data signal to be transmitted to a surface of a well. The data signal may comprise an electromagnetic signal that is driven onto the drill string sections on either side of the insulated connection. As shown in FIG. 4, a conduit 53 and connector 55 are provided for extending and connecting the wiring for sensors and electronics 37 to the isolation connection 51.

Figure 6:
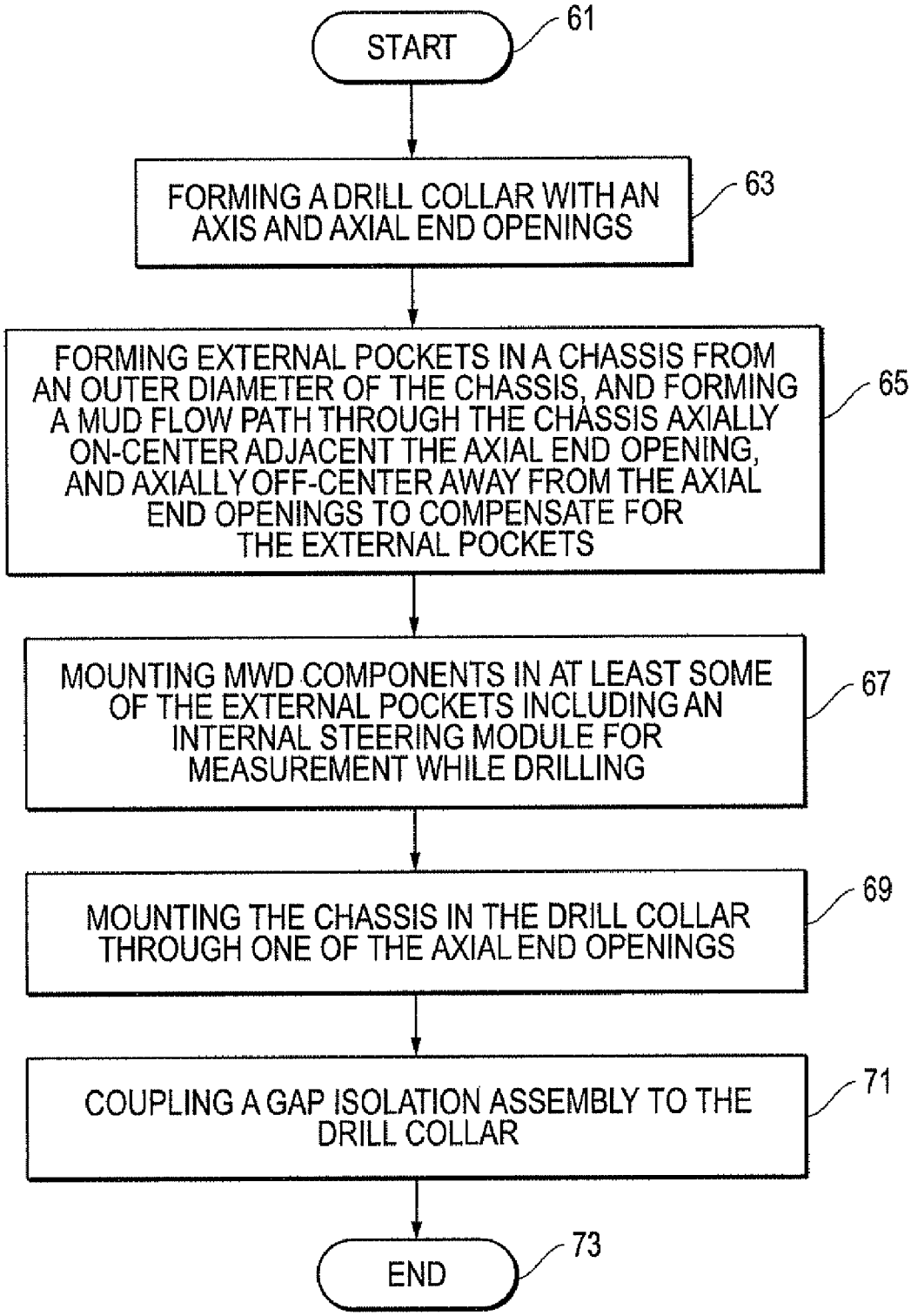
FIG. 6 is a high level flow diagram of one embodiment of a method in accordance with the invention.

FIG. 6 depicts a high level flow diagram of one embodiment of a method in accordance with the invention. In one embodiment, the method comprises configuring a MWD integrated system by starting as indicated at step 61, forming a drill collar with an axis and axial end openings (step 63); forming external pockets in a chassis from an outer diameter of the chassis, and forming a mud flow path through the chassis axially on-center adjacent the axial end openings, and axially off-center away from the axial end openings to compensate for the external pockets (step 65); mounting MWD components in at least some of the external pockets including an internal steering module for measurement while drilling (step 67); mounting the chassis in the drill collar through one of the axial end openings (step 69); coupling a communications device such as a gap isolation assembly to the drill collar (step 71); before ending as indicated at step 73.

In other embodiments, the method may comprise forming the drill collar with a smooth, cylindrical, uniform exterior surface with no external pockets, and further comprise mounting flow diverters adjacent the axial end openings for providing a smooth transition of mud through the chassis and to control material erosion. Alternatively, the mud flow path may be provided with an axial sectional shape comprising a multi-lobed aperture without obstructions extending therein, a wall thickness of the chassis surrounding the mud flow path is selected to withstand a total pressure load comprised of a sum of a maximum hydrostatic pressure in a well and a circulation pressure in the mud flow path, and the chassis has only one seal adjacent the axial end openings.

In still other embodiments, the method may comprise configuring the MWD components as batteries, sensors and electronics, and the sensors and electronics are located opposite the mud flow path, and batteries are located on each side of the mud flow path adjacent the sensors and electronics. In addition, the gap isolation assembly may comprise an isolation connection and permits a data signal to be transmitted to a surface of a well, the data signal comprising an electromagnetic signal that is driven onto drill string sections on either side of the insulated connection; and further comprising alignment pins to maintain an angular orientation of the chassis with respect to an offset bend of a mud motor.

The invention has numerous advantages. For example, the flow path contains no obstructions, thereby allowing the drilling operation to utilize larger sizes and higher concentrations of loss circulation materials. The unique shape and elements of the design permit the chassis to be axially inserted into the modified drill collar so the electronics do not have to be installed and sealed on the sides of the tool. The sizes of the longitudinally milled slots in the chassis may be selectively determined by the size of the components.

The shape of the mud flow path through the tool optimizes the flow area and maintains a wall thickness that can withstand the mud pressure. The flow diverters provide a smooth transition for the mud flow and control material erosion. The flow path contains no obstructions, thereby allowing the drilling operation to utilize larger sizes and higher concentrations of loss circulation materials. In addition, the invention also reduces the number of required seals to only one at each end of the chassis, which enhances the overall system reliability.

While the invention has been shown or described in only some of its forms, it should be apparent to those skilled in the art that it is not so limited, but is susceptible to various changes without departing from the scope of the invention.

We claim:

1. A downhole string for a subterranean application, comprising:

a tool;

a rotary steerable tool mounted to the tool;

a measurement while operating (MWO) integrated system coupled to the rotary steerable tool, the MWO integrated system comprising a collar having an axis, an axial end opening, and a chassis mounted in the collar through the axial end opening, the chassis having external pockets formed in an exterior thereof, MWO components mounted in at least one of the external pockets;

a communications device coupled to the MWO integrated system for transmitting data;

wherein the collar has a smooth, cylindrical, uniform exterior surface with no external pockets;

the communications device comprises at least one of a gap isolation assembly and a mud pulser; and further comprising an internal steering module for measurement while operating.

2. A downhole string according to claim 1, wherein the external pockets are machined into the chassis from an outer diameter of the chassis, and the external pockets comprise longitudinally milled slots.

3. A downhole string according to claim 1, wherein the gap isolation assembly comprises an isolation connection and permits a data signal to he transmitted to a surface of a well, the data signal comprising an electromagnetic signal that is driven onto downhole string sections on either side of the isolation connection.

4. A downhole string for a subterranean application, comprising:

a tool;

a rotary steerable tool mounted to the tool;

a measurement while operating (MWO) integrated system coupled to the rotary steerable tool, the MWO integrated system comprising a collar having an axis, an axial end opening, and a chassis mounted in the collar through the axial end opening, the chassis having external pockets formed in an exterior thereof, MWO components mounted in at least one of the external pockets;

a communications device coupled to the MWO integrated system for transmitting data; and wherein the chassis has a mud flow path extending therethrough it an axial direction, the mud flow path being positioned axially on-center adjacent the axial end opening of the MWO integrated system, and positioned axially off-center away from the axial end opening to compensate for the external pockets.

5. A downhole string according to claim 4, wherein the mud flow path has an axial sectional shape comprising a multi-lobed aperture without obstructions extending therein; and a wall thickness of the chassis surrounding the mud flow path is selected to withstand a total pressure load comprised of a sum of a maximum hydrostatic pressure in a well and a circulation pressure in the mud flow path.

6. A downhole string according to claim 4, wherein the MWO integrated system has only one seal at axial ends of the chassis; and the MWO components are mounted in the chassis slots before the chassis is inserted into the collar from one axial end, and the MWO components comprise batteries, sensors and electronics.

7. A downhole string according to claim 4, wherein the sensors and electronics are located opposite a mud flow path, and batteries are located on each side of a mud flow path adjacent the sensors and electronics, and the MWO integrated system has an alignment pin to maintain angular orientation with respect to the rotary steerable tool.

8. A downhole string for a subterranean application, comprising:

a tool;

rotary steerable tool mounted to the tool;

a measurement while operating (MWO) integrated system coupled to the rotary steerable tool, the MWO integrated system comprising a collar having an axis, an axial end opening, and a chassis mounted in the collar through the axial end opening, the chassis haying external pockets formed in an exterior thereof, MWO components mounted in at least one of the external pockets;

a communications device coupled to the MWO integrated system for transmitting data; and wherein the MWO integrated system further comprises flow diverters adjacent axial ends of the chassis for providing a smooth transition of mud through the chassis and to control material erosion, the flow diverters being retained between the chassis and other drilling subs.

9. A downhole tool, comprising:

a housing that is tubular in shape and having an axis and axial end openings;

a chassis mounted in the housing through one of the axial end openings, the chassis having a mud flow path extending therethrough, at least one cavity formed it an exterior of the chassis for receiving sensor and communications equipment, and at least one circumferential seal between the exterior of the chassis and the housing for providing a barrier for the sensor and communications equipment;

wherein the sensor and communications equipment detects information about a borehole and transmits data uphole; and the mud flow path has an axial sectional shape comprising a multi-lobed aperture without obstructions extending therein.

10. A downhole tool, comprising:

a housing that is tubular in shape and having an axis and axial end openings;

a chassis mounted in the housing through one of the axial end openings, the chassis having a mud flowpath extending therethrough, at least one cavity formed in an exterior of the chassis for receiving sensor and communications equipment, and at least one circumferential seal between the exterior of the chassis and the housing for providing a barrier for the sensor and communications equipment; and wherein the at least one cavity comprises external pockets in the chassis comprising longitudinally milled slots, and the mud flow path is positioned axially on-center adjacent the axial end openings, and positioned axially off-center away from the axial end openings to compensate for the external pockets.

11. A downhole tool according to claim 10, wherein the chassis has only one seal adjacent each of the axial end openings; and the sensor and communications equipment are mounted in the chassis slots before the chassis is inserted into the housing from one axial end, and the sensor and communications equipment are located opposite and on each side of the mud flow path.

12. A downhole tool according to claim 10, further comprising a gap isolation assembly with an isolation connection that permits a data signal to be transmitted to a surface of a well, the data signal comprising an electromagnetic signal that is driven onto drill string sections on either side of the isolation connection; and further comprising alignment pins to maintain an angular orientation of the chassis with respect to the housing.

13. A downhole tool, comprising:

a housing that is tubular in shape and having an axis and axial end openings;

a chassis mounted in the housing through one of the axial end openings, the chassis having a mud flow path extending therethrough, at least one cavity formed in an exterior of the chassis for receiving sensor and communications equipment, and at least one circumferential seal between the exterior of the chassis and the housing for providing a barrier for the sensor and communications equipment;

wherein the housing has a smooth, cylindrical, uniform exterior surface with no external pockets; and further comprising:

flow diverters adjacent the axial end openings for providing a smooth transition of mud through the chassis and to control material erosion, the flow diverters being retained between the chassis and other drilling subs.

14. A downhole tool, comprising:

a housing that is tubular in shape and having an axis and axial end openings;

a chassis mounted in the housing through one of the axial end openings, the chassis having a mud flow path extending therethrough, at least one cavity formed in an exterior of the chassis for receiving sensor and communications equipment, and at least one circumferential seal between the exterior of the chassis and the housing for providing a barrier for the sensor and communications equipment; and wherein a wall thickness of the chassis surrounding the mud flow path is selected to withstand a total pressure load comprised of a sum of a maximum hydrostatic pressure in a well and a circulation pressure in the mud flow path.

15. A method of configuring a MWD integrated system, comprising:

(a) forming a drill collar with an axis and axial end openings;

(b) forming external pockets in a chassis from an outer diameter of the chassis, and forming a mud flow path through the chassis axially on-center adjacent the axial end openings, and axially off-center away from the axial end openings to compensate for the external pockets;

(c) mounting MWD components in at least some of the external pockets including an internal steering module for measurement while drilling;

(d) mounting the chassis in the drill collar through one of the axial end openings; and (e) coupling a gap isolation assembly to the drill collar.

16. A method according to claim 15, wherein step (a) comprises forming the drill collar with a smooth, cylindrical, uniform exterior surface with no external pockets, and further comprising mounting flow diverters adjacent the axial end openings for providing a smooth transition of mud through the chassis and to control material erosion.

17. A method according to claim 15, wherein the mud flow path has an axial sectional shape comprising a multi-lobed aperture without obstructions extending therein, a wall thickness of the chassis surrounding the mud flow path is selected to withstand a total pressure load comprised of a sum of a maximum hydrostatic pressure in a well and a circulation pressure in the mud flow path, and the chassis has only one seal adjacent the axial end openings.

18. A method according to claim 15, wherein the MWD components comprise batteries, sensors and electronics, and the sensors and electronics are located opposite the mud flow path, and batteries are located on each side of the mud flow path adjacent the sensors and electronics; and the gap isolation assembly comprises an isolation connection and permits a data signal to be transmitted to a surface of a well, the data signal comprising an electromagnetic signal that is driven onto drill string sections on either side of the insulated connection; and further comprising alignment pins to maintain an angular orientation of the chassis with respect to an offset bend of a mud motor.

19. A drill string, comprising:

a drill bit;

a mud motor mounted to the drill bit;

a measurement while drilling (MWD) integrated system coupled to the mud motor, the MWD integrated system comprising a drill collar having an axis, an axial end opening, and a chassis mounted in the drill collar through the axial end opening, the chassis having external pockets formed in an exterior thereof, MWD components mounted in at least one of the external pockets, an internal steering module for measurement while drilling, and a mud flow path extending through the chassis in an axial direction;

the drill collar has a smooth, cylindrical, uniform exterior surface with no external pockets;

the mud flow path is positioned axially on-center adjacent the axial end of the MWD integrated system, and positioned axially off-center away from the axial end to compensate for the external pockets; and a gap isolation assembly coupled to the MWD integrated system.

20. A drill string according to claim 19, wherein the external pockets are machined into the chassis from an outer diameter of the chassis, and the external pockets comprise longitudinally milled slots; and the MWD integrated system further comprises flow diverters adjacent the axial ends for providing a smooth transition of mud through the chassis and to control material erosion, the flow diverters being retained between the chassis and other drilling subs.

21. A drill string according to claim 19, wherein the mud flow path has an axial sectional shape comprising a multi-lobed aperture without obstructions extending therein; and a wall thickness of the chassis surrounding the mud flow path is selected to withstand a total pressure load comprised of a sum of a maximum hydrostatic pressure in a well and a circulation pressure in the mud flow path.

22. A drill string according to claim 19, wherein the MWD integrated system has only one seal at axial ends of the chassis;

the MWD components are mounted in the chassis slots before the chassis is inserted into the modified drill collar from one axial end, and the MWD components comprise batteries, sensors and electronics; and the sensors and electronics are located opposite the mud flow path, and batteries are located on each side of the mud flow path adjacent the sensors and electronics.

23. A drill string according to claim 19, wherein the gap isolation assembly comprises an isolation connection and permits a data signal to be transmitted to a surface of a well, the data signal comprising an electromagnetic signal that is driven onto drill string sections on either side of the insulated connection; and the MWD integrated system has an alignment pin to maintain angular orientation with respect to an offset bend of the mud motor.

* * * * *